United States Patent [19]

Miller et al.

[11] Patent Number: 4,745,814

[45] Date of Patent: May 24, 1988

[54] VARIABLE DISPLACEMENT WOBBLE PLATE COMPRESSOR SLIDE AND GUIDE JOINT

[75] Inventors: Gary T. Miller, E. Amherst; John F. Benoit, Lockport, both of N.Y.

[73] Assignee: General Motors Corporation, Detroit, Mich.

[21] Appl. No.: 6,754

[22] Filed: Jan. 27, 1987

Related U.S. Application Data

[63] Continuation-in-part of Ser. No. 888,713, Jul. 24, 1986, abandoned.

[51] Int. Cl.[4] ..... F04B 1/28; F16H 23/04

[52] U.S. Cl. ..... 74/60; 417/222

[58] Field of Search ..... 74/60; 417/222, 269, 417/270; 91/505, 506; 92/12.2

[56] References Cited

U.S. PATENT DOCUMENTS

| | | | |
|---|---|---|---|
| 155,943 | 10/1874 | Hamilton | 74/60 |
| 695,731 | 3/1902 | Judson | 74/60 |
| 1,915,966 | 6/1933 | Wills | 74/60 |
| 2,040,390 | 5/1936 | Loe | 74/60 |
| 2,106,236 | 1/1938 | Burke | 74/60 |
| 3,257,855 | 6/1966 | Dangauthier | 74/60 |
| 3,964,323 | 6/1976 | Seibert | 74/60 |
| 4,061,443 | 12/1977 | Black et al. | 74/60 |
| 4,073,603 | 2/1978 | Abendschein et al. | 74/60 |
| 4,297,085 | 10/1981 | Brucken | 417/222 |
| 4,428,718 | 1/1984 | Skinner | 417/222 |
| 4,480,964 | 11/1984 | Skinner | 417/222 |
| 4,606,705 | 8/1986 | Parekh | 417/222 |

*Primary Examiner*—Lawrence Staab

*Attorney, Agent, or Firm*—R. L. Phillips

[57] ABSTRACT

A variable displacement wobble plate compressor is disclosed having a bearing body with a slot and cylindrical guide surfaces such that the bearing body operates directly between a guide rod and a wobble plate to prevent rotation while permitting angulation of the latter.

2 Claims, 2 Drawing Sheets

VARIABLE DISPLACEMENT WOBBLE PLATE COMPRESSOR SLIDE AND GUIDE JOINT

TECHNICAL FIELD

This is a continuation-in-part of U.S. patent application Ser. No. 888,713, filed July 24, 1986 and now abandoned.

This invention relates to variable displacement wobble plate compressors and more particularly to the multiple axis joint that operates between the guide rod and wobble plate therein to prevent rotation while permitting angulation of the wobble plate.

BACKGROUND OF THE INVENTION

In a variable displacement wobble plate compressor such as that used in motor vehicle engine air conditioning systems, a round guide rod operates through a multiple axis joint to prevent rotation while permitting angulation of the wobble plate. The most advanced of these joints in terms of low wear and reliability comprises a ball that is journaled on the guide rod and received on opposite sides in spherical pockets in two oppositely arranged shoes that each have a semi-cylindrical profile that rides in a radial, concave, semi-cylindrical guide formed in the wobble plate. However, the manufacturing costs of the ball and two shoes is significant even though the ball may be produced on a screw machine. The significant cost results mainly from the shoes which are generally formed with powdered metal and because of their complexity and thin cross section suffer a significantly high rejection rate in the manufacturing process. Furthermore, the assembly costs of these parts is significant because proper orientation of all three must be maintained. Moreover, noise can be encountered when a loose fit occurs in these parts due to tolerance stack up results.

SUMMARY OF THE INVENTION

The present invention reduces the three-piece shoe-ball-shoe assembly to a single piece without any significant loss in wear efficiency and reliability. This new single piece is formed as a bearing body having an outside cylindrical profile that mates with the radial, concave, cylindrical guides on the wobble plate allowing the required relative radial motion between the bearing body and the plate. And instead of an intermediate bearing, there is formed a tapered slot through the cylindrical bearing body that directly receives the guide rod and allows both linear and angular motion of the bearing body on the rod. In one embodiment, the guide rod is round as is conventional and the bearing body slot is shaped accordingly at the place of engagement therewith. In another embodiment, the guide rod is formed with two parallel flat sides and the bearing body slot is shaped accordingly with flat sides that engage therewith. As a result, there is surface contact directly between the wobble plate and the bearing body and either line contact between the latter and the round guide rod or substantial area between the bearing body and guide rod where the slot and guide rod are flat sided. Manufacturing advantages result in that the single bearing body can be machined from rod stock on a screw machine or molded of powdered metal or plastic. Further as to the latter, a plastic is preferably selected that has both lubricity and a high damping factor not normally available in metal. In addition, the assembly costs are reduced with the elimination of two parts and their required orientation.

DESCRIPTION OF THE PREFERRED EMBODIMENT

These and other objects, advantages and features of the present invention will become more apparent from the following description and drawing in which.

Figure 1:
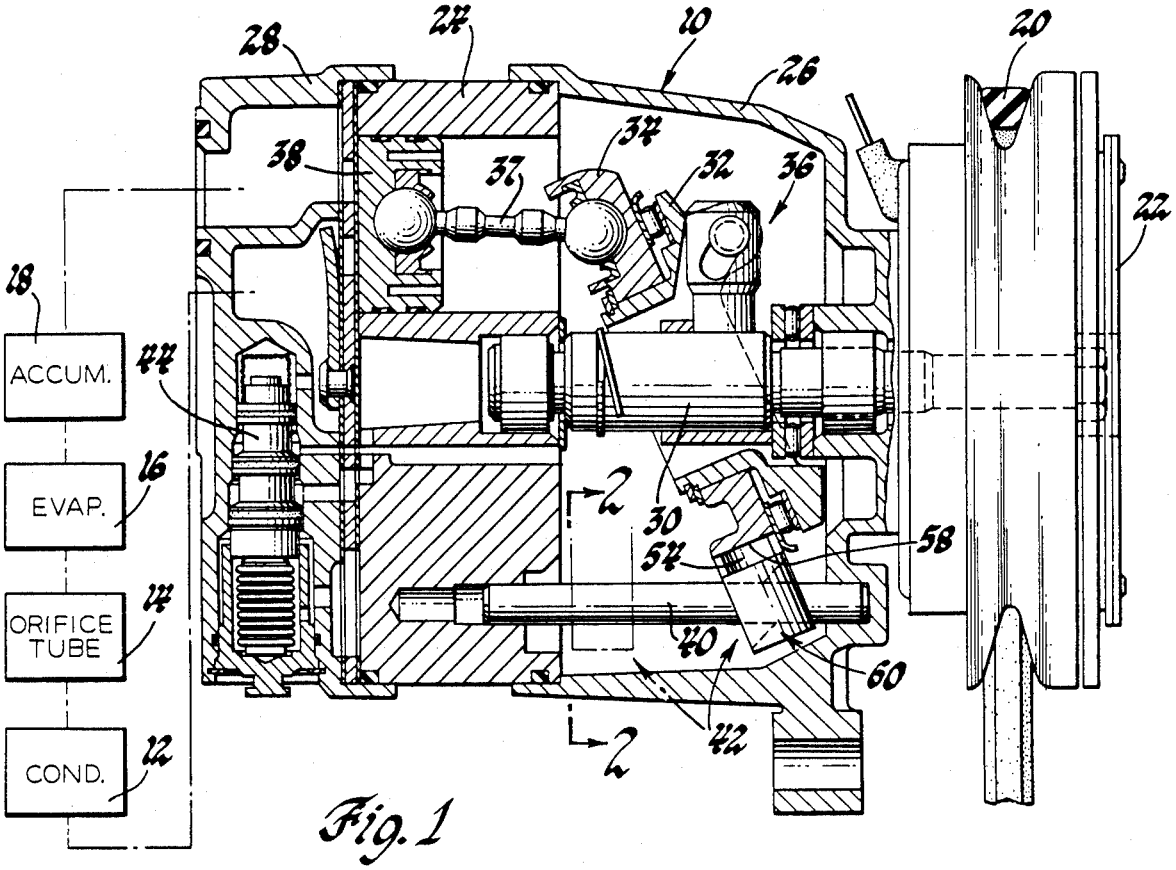
FIG. 1 is a longitudinal sectional view of a variable displacement wobble plate compressor having incorporated therein one embodiment of the multiple axis joint of the present invention. This figure further includes a schematic of a motor vehicle air conditioning system in which the compressor is connected.
Figure 2:
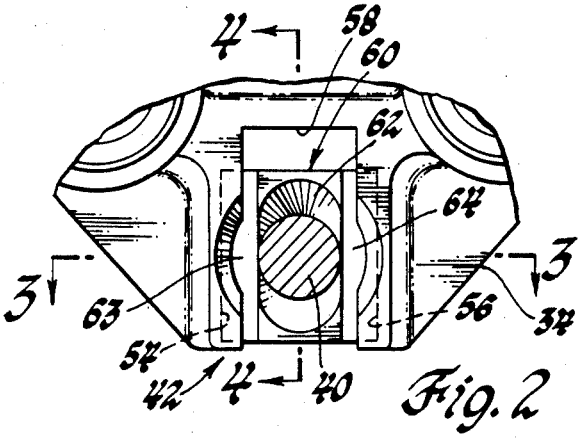
FIG. 2 is an enlarged view taken along the line 2—2 in FIG. 1.

Referring to the drawings wherein the same numbers are employed to identify the same parts throughout the several views, there is shown in FIG. 1 a variable displacement wobble plate compressor 10 adapted for use as a refrigerant compressor and connected in a motor vehicle air conditioning system having the normal condenser 12, orifice tube 14, evaporator 16 and accumulator 18 arranged in that order between the compressor's discharge and suction sides. The compressor is driven by the motor vehicle's engine (not shown) through a V-belt 20 and electromagnetic clutch 22 and comprises a cylinder block 24 that is closed at one end by a crankcase 26 and at the other end by a cylinder head 28. A drive shaft 30 connected to the output of the clutch is rotatably mounted in the cy linder block and crankcase and drives a drive plate 32 that in turn wobbles a wobble plate 34 in the compressor's wobble plate mechanism 36 enclosed by the crankcase. The wobble plate 34 operates through ball-ended connector rods 37 to drive five pistons 38 mounted in the cylinder block (only one rod and piston being shown). A round guide rod or pin 40 mounted in the compressor parallel to the drive shaft operates through a multiple axis joint 42 to prevent rotation while permitting angulation of the wobble plate from the full stroke position shown in outline in FIG. 1 to a minimum stroke position shown in phantom line in the same view. A control valve 44 mounted in the cylinder head 28 responds to both suction and discharge pressure to control the pressure differential between the crankcase and the suction pressure and thereby control the angle of the wobble plate and thus the displacement of the compressor. The compressor thus far described, apart from the details of the multiple axis joint now to be described, is like that disclosed in U.S. Pat. No. 4,428,718 assigned to the assignee of this invention and which is hereby incorporated by reference.

Figure 4:
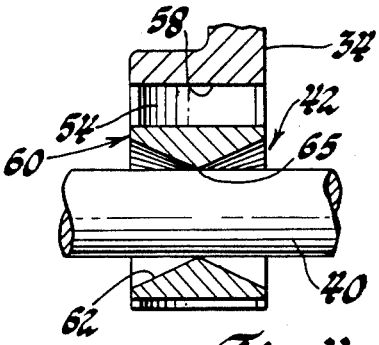
FIG. 4 is a view taken along the line 4—4 in FIG. 2.
Figure 3:
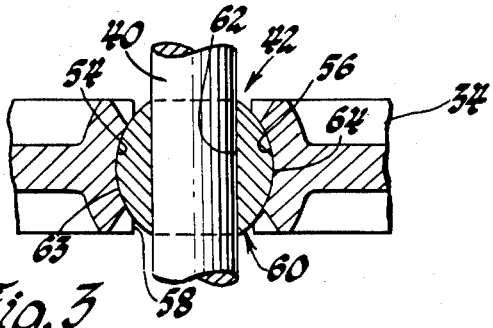
FIG. 3 is a view taken along the line 3—3 in FIG. 2.
Figure 5:
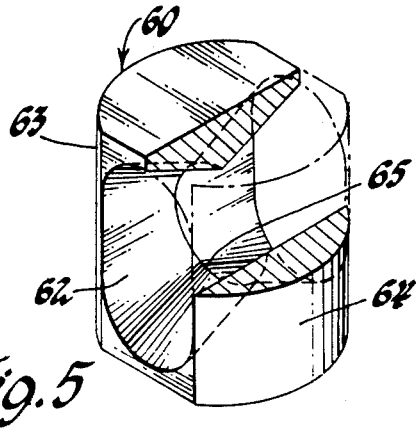
FIG. 5 is an enlarged three-dimensional view of the one-piece bearing body in the previous figures.
Figure 6:
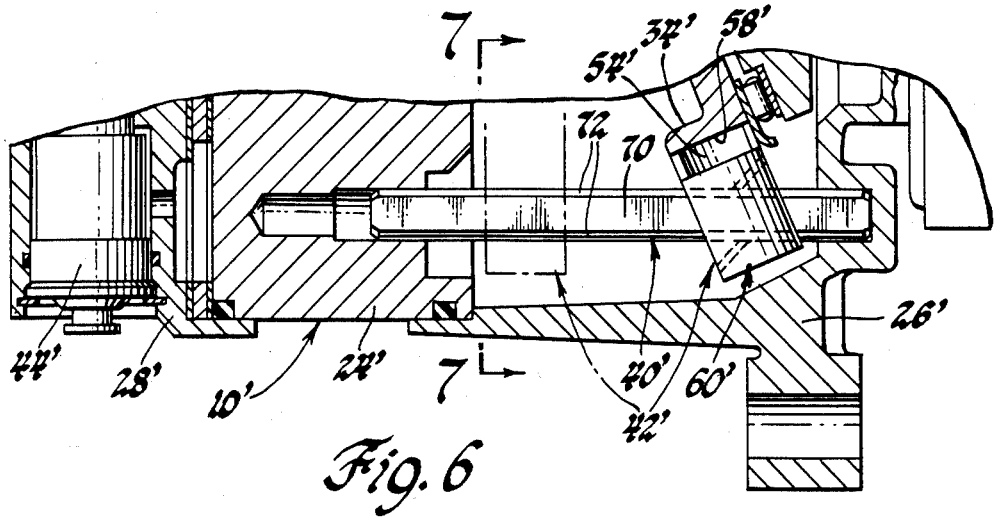
FIG. 6 is a view of the lower portion of the compressor in FIG. 1 but with another embodiment of the multiple axis joint of the present invention.

Describing now the multiple axis joint 42 as best seen in FIGS. 2–5, there are formed a pair of opposed, concave, cylindrical, radially extending guides 54 and 56 in a radial slot 58 in the throttle plate through which the guide rod passes. A bearing body 60 having a slot 62 that slidably receives the guide rod has convex cylindrical surfaces 63 and 64 on opposite sides thereof slidably received in the respective radially extending guides 54 and 56 in the wobble plate. As best seen in FIGS. 4 and 5, the slot 62 through the bearing body tapers inwardly at both ends from an oval shape to a round shape where they intersect as a circular line of engagement 65 with and about the guide rod. This tapering of the slot allows angular as well as linear motion of the bearing body on the guide rod as the wobble plate is angled between its two extreme positions without any loss of contact about the guide rod with the bearing body and wherein the bearing body is caused to slide in the wobble plate guides. In such relative movement, there is thus substantial surface contact directly between the wobble plate and the bearing body but less direct contact between the bearing body and the guide rod. However, this latter contact may be expanded as seen in the embodiment in FIGS. 6–10, to present more wear surface should the wear prove significant and depending on the particular combination of materials selected for the guide rod, bearing body and wobble plate.

Figure 7:
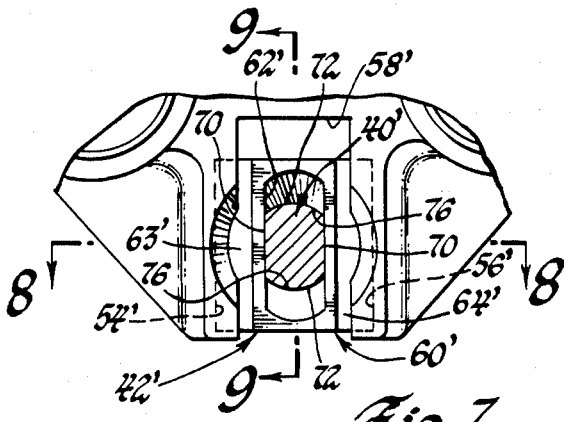
FIG. 7 is an enlarged view taken along the line 7—7 in FIG. 6.
Figure 9:
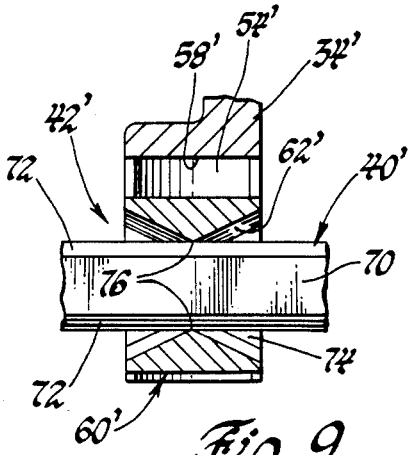
FIG. 9 is a view taken along the line 9—9 in FIG. 7.
Figure 8:
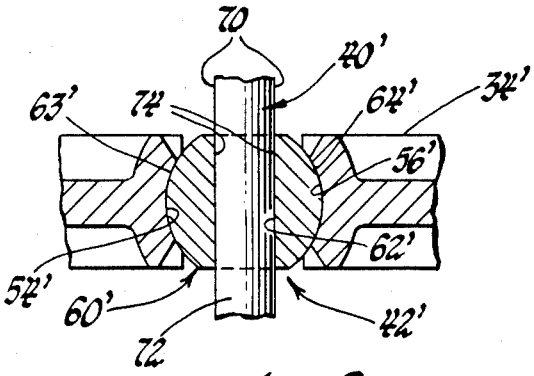
FIG. 8 is a view taken along the line 8—8 in FIG. 7.
Figure 10:
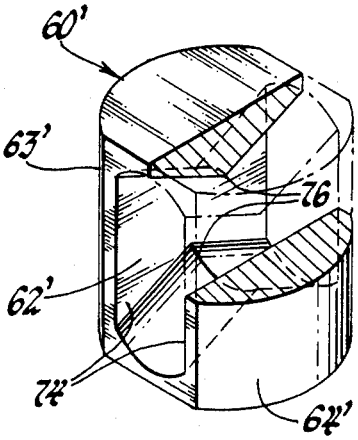
FIG. 10 is an enlarged three-dimensional view of the one-piece bearing body in FIGS. 6–9.

In the embodiment in FIGS. 6–10, parts and details similar to those in FIGS. 1–5 are identified by the same reference numerals only primed and altered structure where otherwise not readily so referenced is identified by new numerals. As seen in FIGS. 6–9, the guide rod 40' of the multiple axis joint 42' is formed with parallel flat sides 70 along the length thereof leaving diagonally opposite and parallel rounded or fixed radius arcuate sides 72. And the slot 62' in the bearing body 60' has flat sides 74 that extend parallel to each other and the flat sides of the guide rod so as to have flat surface-to-surface contact therewith radial to the centerline of the wobble plate 34'. The rounded or fixed radius arcuate sides of the slot, however, remain tapered inwardly from both ends as before so as to converge at the center of the bearing body but now at two diagonally oppositely located circular line segments 76 as seen in FIGS. 7, 9 and 10 that contact with the rounded sides 72 of the guide rod to allow angular as well as linear motion of the bearing body on the guide rod while the bearing body slides in the wobble plate guides like in the FIGS. 1–5 embodiment. And thus the bearing load area for resisting rotation of the wobble plate is now the width of the guide rod flats 70 times the length of the slot flats 74 which is also the full width of the bearing body as viewed alongside the guide rod.

The bearing body may be manufactured in a very cost-effective manner such as by being machined from rod stock on a screw machine or molded of plastic or powdered metal. Preferably, the bearing body is formed of a bearing grade plastic material such as polyimide which has inherent lubricity and in addition a significant damping factor not normally available with metal. The guide rod may also be manufactured in a very cost-effective manner even in the flat-sided form by machining either round or rectangular bar stock or using barstock extruded to the desired cross-sectional shape and with a material selection of either metal or plastic compatible with the bearing body. Furthermore, it will be appreciated that the assembly cost is reduced as compared with the prior three-part design as a result of the elimination of two parts and their respective orientation.

The above described preferred embodiments are illustrative of the invention which may be modified within the scope of the appended claims.

The embodiments of the invention in which an exclusive property or privilege is claimed are defined as follows:

1. In a variable displacement wobble plate compressor having a guide rod that operates through a multiple axis joint to prevent rotation while permitting angulation of a wobble plate, the improvement comprising a cylindrical bearing body slidably received on opposite sides in a pair of oppositely facing, concave, cylindrical, radially extending guides on the wobble plate, said bearing body having a slot therethrough converging inwardly from an oval shape on opposite sides of the bearing body so as to slidably receive the guide rod thereabout and permit angulation of the bearing body relative to the guide rod while maintaining contact about the guide rod with the bearing body in the slot, said guide rod and slot having parallel flat sides that contact over a substantial surface area to prevent rotation of the wobble plate.

2. In a variable displacement wobble plate compressor having a guide rod that operates through a multiple axis joint to prevent rotation while permitting angulation of a wobble plate, the improvement comprising a bearing body slidably received on radially extending guides on the wobble plate, said bearing body having a slot therethrough converging inwardly from an oval shape on opposite sides of the bearing body so as to slidably receive the guide rod thereabout and permit angulation of the bearing body relative to the guide rod while maintaining contact about the guide rod with the bearing body in the slot, said guide rod and slot having parallel flat sides that contact over a substantial surface area to prevent rotation of the wobble plate.

* * * * *